US005289350A

United States Patent [19]

Gehrt

[11] Patent Number: 5,289,350

[45] Date of Patent: Feb. 22, 1994

[54] PIVOTABLE HOLDING MECHANISM FOR AN OPTICAL ELEMENT

[75] Inventor: Joachim Gehrt, Munich, Fed. Rep. of Germany

[73] Assignee: Sachtler AG Kommunikationstechnik, Fed. Rep. of Germany

[21] Appl. No.: 416,721

[22] Filed: Oct. 3, 1989

[30] Foreign Application Priority Data

Oct. 4, 1988 [DE] Fed. Rep. of Germany ... 8812497[U]

[51] Int. Cl.[5] ..... F21V 17/02

[52] U.S. Cl. ..... 362/18; 362/280; 362/281; 362/283; 362/433

[58] Field of Search ..... 362/16, 18, 280, 281, 362/282, 283, 253, 322, 323, 433, 449

[56] References Cited

U.S. PATENT DOCUMENTS

| | | | |
|---|---|---|---|
| 2,009,145 | 7/1935 | Nathan | 362/323 |
| 2,059,361 | 11/1936 | Kenworthy | 362/323 |
| 2,614,783 | 10/1952 | Spear | 362/281 |
| 3,258,586 | 6/1966 | Blizzard | 362/323 |
| 4,775,566 | 10/1988 | Lowell et al. | 362/283 |

FOREIGN PATENT DOCUMENTS

| | | | |
|---|---|---|---|
| 44249 | 4/1910 | Austria | 362/281 |
| 495844 | 10/1919 | France | 362/281 |
| 20402 | of 1907 | United Kingdom | 362/281 |

*Primary Examiner*—Ira S. Lazarus
*Assistant Examiner*—Richard Cole
*Attorney, Agent, or Firm*—Davis, Bujold & Streck

[57] ABSTRACT

A lamp used in photography and television comprising a housing having a filter cavity into which an optical element provided with a handle can be introduced, the housing having first and second shafts situated between two sidewalls of a holding device and extending in a longitudinal direction of the housing and bridging the filter cavity, the handle of the optical element is provided with first and second recesses which are arranged to engage the first and second shafts, respectively, the first shaft being surrounded by the first recess of the handle to allow the optical element to swing about the first shaft from a working position, in which the optical element is located within the filter cavity, into a second position in which the optical element is removed from the filter cavity and the second recess engages the second shaft, and a locking mechanism is provided for retaining engagement of the second recess with the second shaft when the optical element is in the second position.

4 Claims, 3 Drawing Sheets

PIVOTABLE HOLDING MECHANISM FOR AN OPTICAL ELEMENT

The invention concerns a lamp.

These lamps are used in photography, filming and television works. They have a housing where a burner and a reflector are accommodated as source of light. In addition, a filter cavity is provided in the housing in which optical elements, such as filters or intermediate lenses, can be introduced. Hereinafter, those optical elements will be generally designated as filters. For larger lamps in the professional field, several such filters are available which are provided with a handle and thus can be introduced in the filter cavity. If the filter is no longer to be used, or is replaced by another filter, care must be taken that the filter that has been intensively heated by the light within the housing, certainly even hot filters, be treated with extreme care until completely cooled in order to avoid damage. In the case of small lamps, especially for the amateur field, it is known to use a swivel design, in the area of a light gate of the lamp, in which filter plates are also used. Said design with the filter plates is then tilted in front of the lamp around an axis perpendicular to the longitudinal direction. After being used, the filter is again turned away from the optical path. But this solution has the disadvantage that the action of the light gate is impaired by the filter turned away from the optical path.

The invention is based on the problem of providing a lamp of the kind in question with which is ensured safe manipulation and reliable cooling of the filter after having been used.

Accordingly, the essential idea of the invention consists in making it possible, by a special configuration of the handle, to swing out from the housing of the lamp, around a shaft that bridges the light cavity, a filter that is replaceable per se. In this position, in which the filter is then locked, the filter can remain until cooled. The filter can also be easily swung again in the filter cavity. It is also possible to provide such a holding device for a filter on each of the two sides of the housing.

Such a construction has the advantage of easy manipulation of the filter and, in addition, it does not hinder the action of the light gate. The holding device and the filter are easy to build. The operation of swinging the filter in and out can take place very reliably.

The invention is explained in detail in an embodiment with reference to the drawings. In the drawings.

Figure 1:
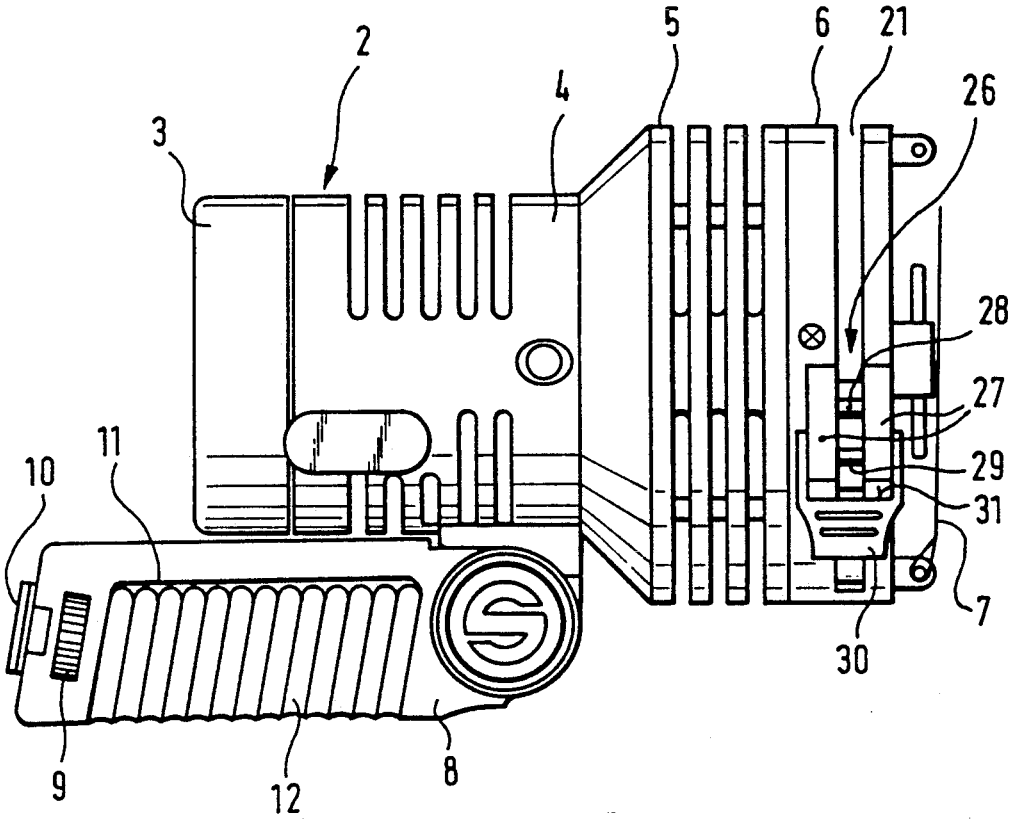
FIG. 1 is a side view of a lamp according to the invention.

FIG. 1 shows a lamp 1 with a housing 2 made by injection molding. The housing 2 is composed of several parts, namely, a bottom lid 3 that accommodates the electronics or electric devices, a burner housing that accommodates the burner, a reflector housing that accommodates a reflector and a gate carrier connected with the reflector housing for gate wings 7 of a light gate. A tiltable handle 8 is connected with the burner housing 4, which has on its free end a stand pedestal 10 adjustable by means of a knurled screw 9 for superimposing the whole lamp on a stand. A compartment 11 is also provided in the handle 8 for a substitute burner which is covered by means of a sliding lid 12.

The gate carrier 6 has a filter cavity 21 in which a filter 22 is insertable. The filter here covers the whole surf ace of the ref lector. The filter 22 has a flap-shaped handle 23 which is provided on a longitudinal side with first and second recesses 24 and 25, respectingly. The first recess facing the filter 22 constitutes here a substantially L-shaped detent.

Figure 3:
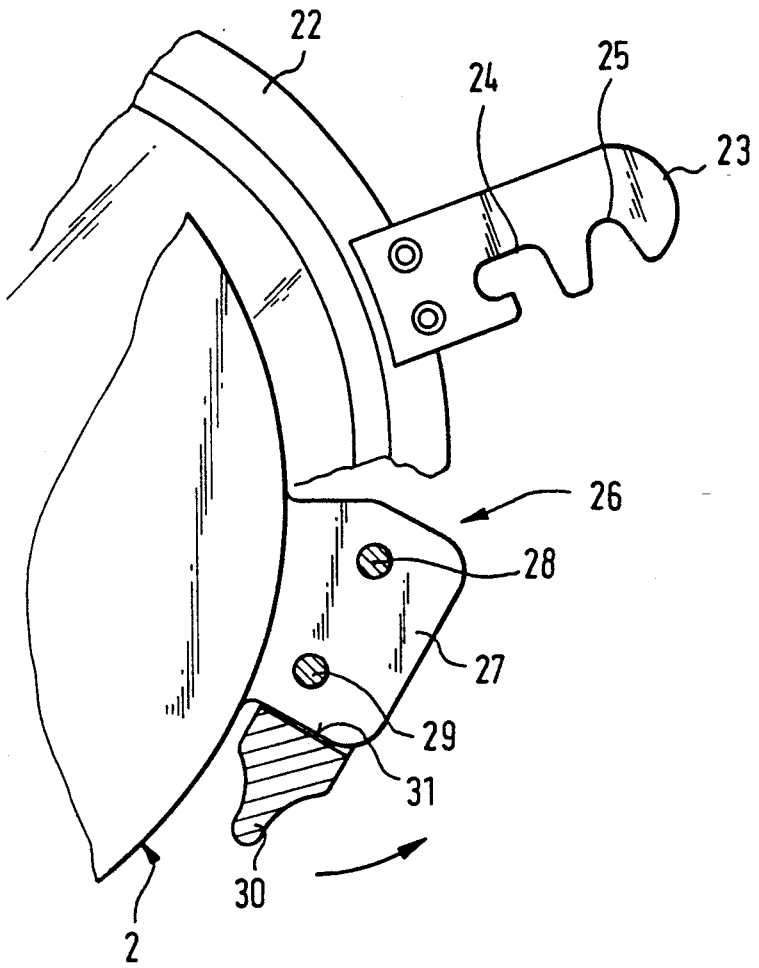
FIG. 3 is a diagrammatic representation of the filter with the holding device.

In the lateral area of the lamp, a holding device 26 is also provided which has on each of the two sides of the light cavity 21 a sidewall 27 between which two shafts 28 and 29, which as shown in FIG. 3 are superposed spaced apart, extend in the longitudinal direction of the lamp. Around the lower (second shaft 29 a detent bracket 30 is also swingable which surrounds like a fork both sidewalls 27 of the holding device 26 and has on the base of the fork a contact or stop surface 31.

Figure 2:
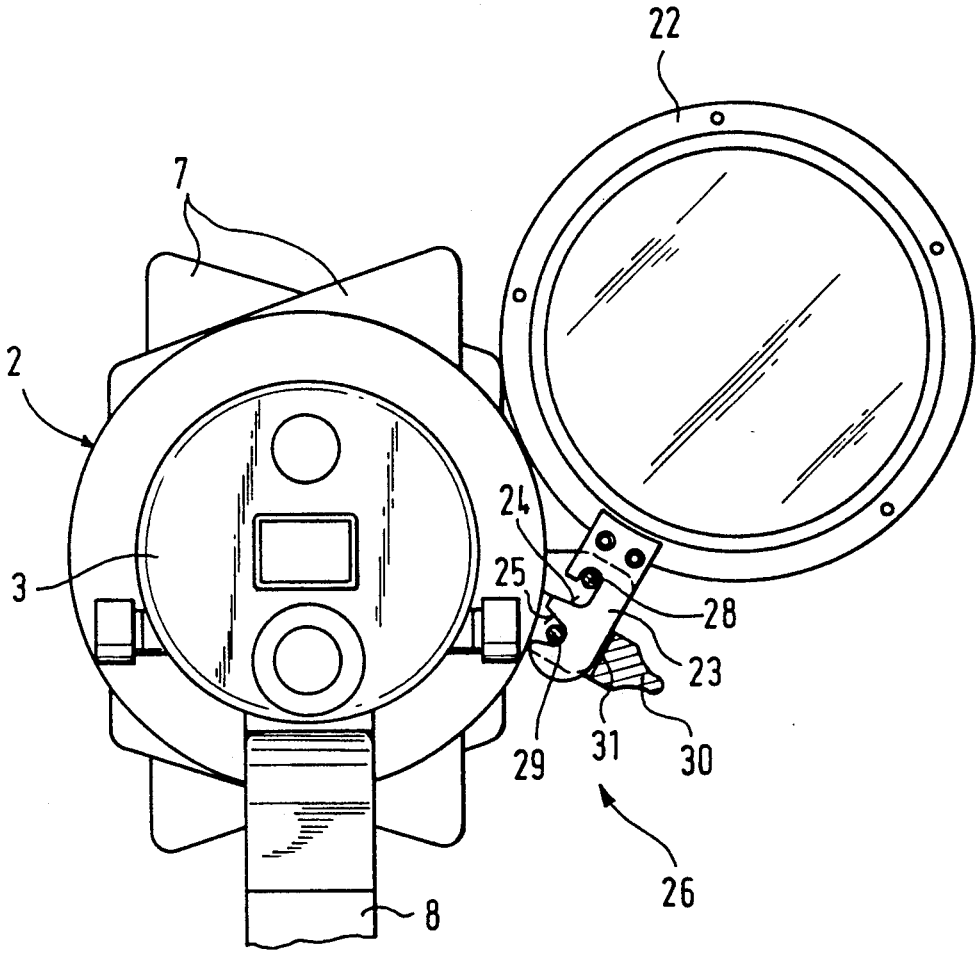
FIG. 2 is a rear view of a lamp according to the invention with the filter swung out.

During use, the filter 22 is pushed into the filter cavity wherein then, by brief rotation and drawl the handle, the L-shaped detent 24 meshes in the upper (first) shaft 28. The filter is now in a working position. If it is to be swung out from this position, the filter is swung around the shaft 28 until the second recess 25 of the handle 23 surrounds like a fork the lower shaft 29 of the holding device 26. The detent bracket 30 is then swung in the direction of the arrow shown in FIG. 3 so that its stop surface 31 abuts on the edge of the handle 23 opposite the recesses 24 and 25. The filter is locked (retained) in this position, as shown in FIG. 2. With the filter swung out and locked, the lamp can be further operated in the traditional manner until the filter is again swung into the filter cavity or removed from the holding device 26.

I claim:

1. A lamp for use in photography and television having a housing in which a burner and a reflector, as a source of light, are accommodated and which has a filter cavity for introducing an optical element provided with a handle, wherein first and second shafts, situated between two sidewalls of a holding device connected to said housing on both sides of said filter cavity, are provided, the first and the second shafts extend in a longitudinal direction of the housing and bridge the filter cavity, the handle is provided with first and second recesses which are arranged to engage the first and the second shafts, respectively, the first shaft is engaged by the first recess of the handle so that the optical element is swingable about the first shaft from a working position, in which the optical element is located within the filter cavity, into a swung out position in which the optical element is removed from the filter cavity and the second recess engages the second shaft, and means for retaining the engagement of the second recess with the second shaft when the optical element is in the swung out position.

2. A lamp for use in photograph, filming and television having a housing in which a burner and a reflector, as a source of light, are accommodated and which has a filter cavity for introducing an optical element provided with a handle, characterised in that first and second shafts (28, 29), are situated between two sidewalls (27) of a holding device (26) connected with said housing (2) on both sides of said filter cavity (21) and both shafts extend in the longitudinal direction of the housing and bridge said filter cavity (21), said first shaft is surrounded by a first recess (24) in said handle (23) so that said optical element (22) is swingable about said first shaft (28) from a position located within the filter cavity to a swung out position remote from the filter cavity, the second shaft (29) is surrounded by a second recess (25) in said handle (23) when said optical element (22) is in the swung out position, and a detent bracket (30), swingable around said second shaft (29) and surrounding like a fork said sidewalls (27) of said holding device (26), is provided to fix said handle (23) when said optical element (22) is in the swung out position.

3. A lamp according to claim 2, characterized in that said first recess (24) in said handle (23) of said filter (22) is an L-shaped slot.

4. A lamp according to claim 2, characterized in that said filter cavity (21) is situated with said holding device (26) in a gate carrier (6) connected with said housing (2) for accommodating a light gate (7).

* * * * *